United States Patent [19]

Riegler et al.

[11] 4,121,481

[45] Oct. 24, 1978

[54] DEVICE AT A CONVERTER WITH A TILTING DRIVE

[75] Inventors: Ernst Riegler, Enns; Manfred Schmidt, Linz, both of Austria

[73] Assignee: Vereinigte Österreichische Eisen-und Stahlwerke - Alpine Montan Aktiengesellschaft, Linz, Austria

[21] Appl. No.: 749,238

[22] Filed: Dec. 10, 1976

[30] Foreign Application Priority Data

Dec. 17, 1975 [AT] Austria ..... 9571/75

[51] Int. Cl.[2] ..... F16H 57/00

[52] U.S. Cl. ..... 74/410

[58] Field of Search ..... 74/410

[56] References Cited

U.S. PATENT DOCUMENTS

| | | | |
|---|---|---|---|
| 3,388,608 | 6/1968 | Durand | 74/410 |
| 3,390,585 | 7/1968 | Henne | 74/410 |
| 3,572,150 | 3/1971 | Durand | 74/410 |
| 3,736,807 | 6/1973 | Reitter et al. | 74/410 |

*Primary Examiner*—Leonard H. Gerin

*Attorney, Agent, or Firm*—Brumbaugh, Graves, Donohue & Raymond

[57] ABSTRACT

A device at a converter with a tilting drive, a tilting trunnion on which the tilting drive is suspended, and a torque support resiliently supported on the base, also has an adjustment means, by which the tilting drive can be fixed relative to the base during blowing.

6 Claims, 5 Drawing Figures

DEVICE AT A CONVERTER WITH A TILTING DRIVE

BACKGROUND OF THE INVENTION

The invention relates to a converter with a tilting drive suspended on a tilting trunnion of the converter and a torque support resiliently supported on the base.

When making steel, the reactions of the gaseous refining agent with the liquid bath cause oscillations, which can lead to nodding movements of up to ± 50 mm at the mouth of the converter when it is in the blowing position. Since the drive motors of the tilting drive are braked during the blowing procedure, the oscillations are transmitted via the tilting drive to the resilient torque support. The oscillations, which have a frequency up to a few Hz, substantially detract from the useful life of the resilient torque support, since the natural frequency of the resilient torque support lies in the frequency range of the converter oscillations. As a result sympathetic vibrations form, which may lead to a breaking of the torque support requiring a halt to plant operations and losses in production.

SUMMARY OF THE INVENTION

The invention aims at preventing the above-described disadvantages and has as its object to create a safety means which prevents a vibration of the reslient torque support which is sympathetic with the oscillation of the converter.

According to the invention, this object is achieved in a converter of the above-defined kind with a device which is characterized in that during the blowing procedure the tilting drive is fixable relative to the base by an adjustment means. Thus converter oscillations are prevented from being transmitted to the torque support. Pressure medium cylinders, screw spindles, knee lever systems or adjusting wedges can be provided as the adjustment means.

When the torque support comprises a torque rod rotatably journaled at its ends, two levers secured to the torque rod at a distance from each other and two guide rods hinged to the levers as well as to the tilting drive, a preferred embodiment of a device according to the invention is characterized in that on the base below the ends of the guide rods connected to the levers pressure medium cylinders are arranged. Since the pistons of the pressure medium cylinders can be pressed toward the ends of the guide rods, the tilting drive is fixed relative to the base. Thereby the transmission of forces from the converter to the torque rod is prevented and torsional oscillations of the torque rod are no longer possible.

Advantageously a number of pressure medium cylinders — preferably four — are allocated to each end of the guide rods and embrace the levers in a fork-like manner, which pressure medium cylinders are arranged below the fork-like ends symmetrical to the lever.

Suitably, in the fixing position of the tilting drive, the supply conduits of the pressure medium cylinders can be closed by a closure means, whereby the pressure medium cylinders for fixing the tilting drive, only need to be actuated by a pressure which suffices to eliminate any plays possibly present in the hinging areas of the guide rods.

In order to void the possibility that the converter can be tilted in the fixing position of the tilting drive, i.e. when the tilting drive is not resiliently supported on the base, the tilting drive is electrically interrupted in the fixing position.

BRIEF DESCRIPTION OF THE DRAWINGS

The invention shall now be described in more detail by way of example and with reference to the accompanying drawings, wherein.

DESCRIPTION OF AN EXEMPLARY EMBODIMENT

Figure 1:
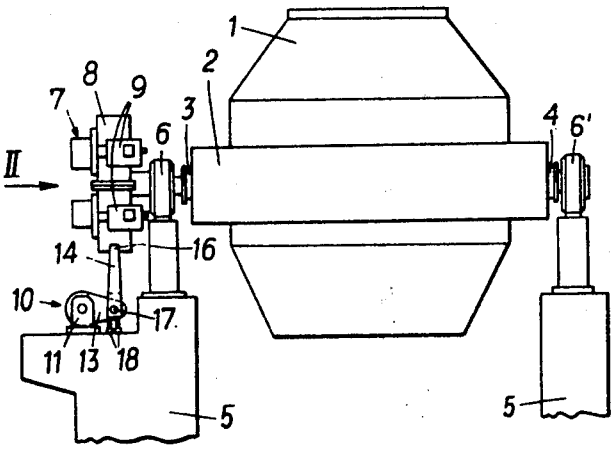
FIG. 1 is a front view of the converter arrangement.
Figure 2:
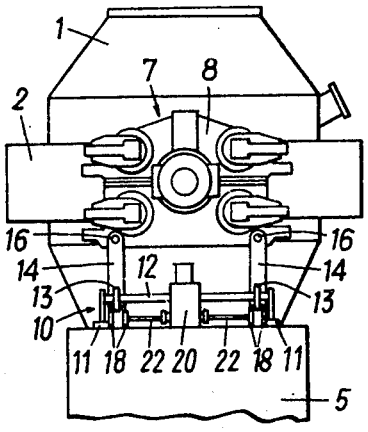
FIG. 2 is a side view in the direction of the arrow II of FIG. 1.
Figure 3:
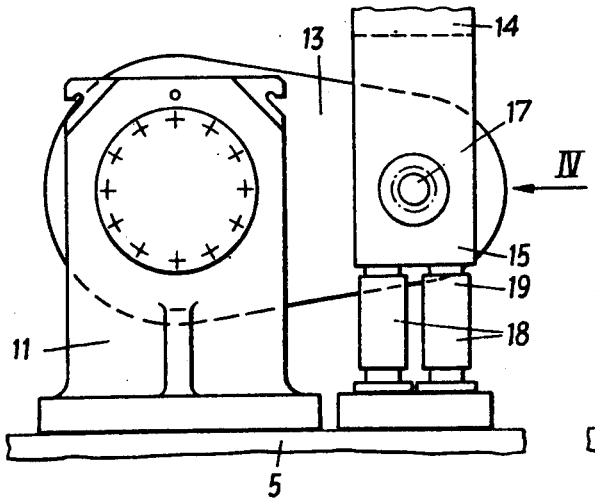
FIG. 3 shows a detail of the torque support on an enlarged scale in a view like that of FIG. 1.

A converter denoted by 1 is mounted in a carrying ring 2, which ring is rotatably journaled with its tilting trunnions 3 and 4 in bearings 6 and 6' supported on a base 5. The tilting trunnion 3, which is extended beyond the bearing 6, carries a tilting drive 7 at its end, the spur gear wheel of the tilting drive being arranged in a gear box 8 and driven by four pinions distributed over the periphery of the spur gear wheel. The pinions are driven by motors 9, which can be braked by brakes not illustrated. A torque support 10 provides for a resilient supporting of the gear box on the base 5. Torque rod 12, rotatably journaled in bearings 11 secured to the base 5, is torsion-strained during a tilting of the converter via levers 13 secured to its ends and guide rods 14 each. Each guide rod 14 is articulately connected at one end 15 to a lever 13 and is hinged with its other end 16 to the gear box 8.

In order to keep the guide rods from being a bending stress and to assume that the levers are not torsion-strained when a tilting moment occurs, the ends 15 of the guide rods 14 connected to the levers 13 are fork-shaped and each lever protrudes into the middle thereof, the ends 15 being connected with the lever 13 by a bolt 17.

Figure 4:
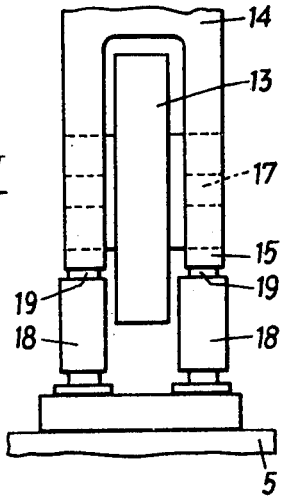
FIG. 4 shows this detail in the direction of the arrow IV of FIG. 3, and FIG. 5 schematically illustrates the connection diagram of the pressure medium cylinders.
Figure 5:
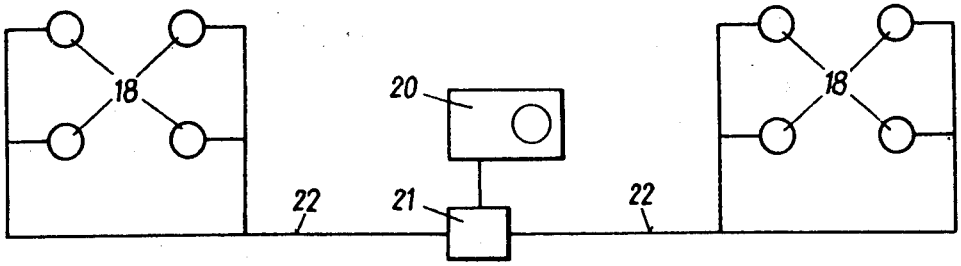

On the base 5, below the fork-shaped ends 15 of the guide rods 14, pressure medium cylinders 18 are arranged. Four such pressure medium cylinders are arranged below each guide rod and the pistons 19 of the pressure medium cylinders are pressed against the ends 15 of the guide rods. By actuation of the pressure medium cylinders 18 the tilting drive is fixable relative to the base. In order to assume that the guide rods are not subjected to a bending stress by the pressure medium cylinders, the pressure medium cylinders 18 are each symmetrically arranged with respect to the lever 13 (FIG. 4). Since the fork-shaped configuration of the ends 15 of the guide rods 14 makes it possible to arrange a number of pressure medium cylinders 18 below each one of the guide rods, a safety factor is provided to protect against the failure of one of the pressure medium cylinders. A motor pump unit 20 provides for the pressure necessary for actuating the hydraulically actuated pressure medium cylinders. A closure means 21 enables closing of the supply conduits 22 of each of the pressure medium cylinder groups allocated to a guide rod 14. After closure of the supply conduits 22, pressure compensation can only occur within one of these groups, between the two groups a pressure compensation is only possible when the closure means 22 are open (see FIG. 5).

The device according to the invention functions in the following manner: When the converter has been turned into the blowing position, the motors of the tilting drive are braked. Thereupon the pressure medium cylinders are actuated, so that their pistons press against the ends of the guide rods. When the pressure force reaches approximately 2.5 metric tons per pressure medium cylinder, the supply conduits 22 are closed. Thereupon the motor pump unit 20 can be turned off. Pressure loads on the guide rods caused by oscillations of the converter are lead off into the base 5 by the pressure medium cylinders 18. In order to meet this requirement with high pressure loads, the pressure medium cylinders are constructed for very high pressure loads, approximately up to 40 metric tons. When the tilting drive is turned on again, the closure means 21 has to be opened again. Movements of the guide rod caused by a tilting moment lead to a lowering of the pistons, so that the guide rods are freely movable again and forces can be transmitted to the torque rod. As a safety measure, the tilting drive 7 is electrically interrupted when the pressure medium cylinders 18 are actuated.

What we claim is:

1. In a converter tilting device with a tilting drive, a tilting trunnion connected to the converter and having the tilting drive suspended thereon, and a torque support resiliently supporting the tilting drive on a base, the improvement comprising an adjustment means for fixing the tilting drive relative to the base during blowing.

2. A device as set forth in claim 1, wherein the torque support comprises a torque rod rotatably journaled at its ends in bearings, two levers secured to the torque rod at a distance from each other, and two guide rods hinged to the levers as well as to the tilting drive, and wherein the adjustment means are pressure medium cylinders with pistons arranged below the ends of the guide rods hinged to the levers, the pistons being pressable toward said ends of the guide rods to fix the tilting drive relative to the base.

3. A device as set forth in claim 2, wherein said ends of the guide rods are fork-shaped to embrace the pertaining levers, a plurality of pressure medium cylinders being allocated to each one of said ends and arranged therebelow, said cylinders being symmetrically located with respect to the pertaining lever.

4. A device as set foth in claim 3, wherein four pressure medium cylinders are allocated to each one of said ends.

5. A device as set forth in claim 2, further comprising supply conduits for the pressure medium cylinders and a closure means by which the supply conduits are closable when the tilting drive is in the fixed position.

6. A device as set forth in claim 1, wherein the tilting drive is electrically interrupted, when the tilting drive is in the fixed position.

* * * * *

UNITED STATES PATENT OFFICE

CERTIFICATE OF CORRECTION

Patent No. 4,121,481 Dated Oct. 24, 1978

Inventor(s) Riegler et al.

It is certified that error appears in the above-identified patent and that said Letters Patent are hereby corrected as shown below:

First page, first line of ABSTRACT, delete "device at a".

Col. 1, lines 46-48, "on the base below the ends of the guide rods connected to the levers pressure medium cylinders are arranged" should read --pressure medium cylinders are arranged on the base below the ends of the guide rods connected to the levers--; line 62, delete the comma after "drive".

Col. 2, line 34, after "14" delete "each"; line 38, after "being" insert --subjected to a--; line 39, "assume" should read --assure--; line 52, "assume" should read --assure--.

Col. 4, line 20, "foth" should read --forth--.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*